US006015034A

United States Patent [19]

Rupflin

[11] Patent Number: 6,015,034

[45] Date of Patent: Jan. 18, 2000

[54] WARP BEAM COUPLING

[75] Inventor: Fritz Rupflin, Sorgersweg, Germany

[73] Assignee: Lindauer Dornier, Lindau, Germany

[21] Appl. No.: 09/084,058

[22] Filed: May 26, 1998

[30] Foreign Application Priority Data

Jun. 7, 1997 [DE] Germany ..... 197 24 150

[51] Int. Cl.[7] ..... F16D 11/10; D03D 49/06

[52] U.S. Cl. ..... 192/69.8; 139/100; 192/114 R

[58] Field of Search ..... 139/100; 192/69.8, 192/114 R, 86, 99 S

[56] References Cited

U.S. PATENT DOCUMENTS

| | | | |
|---|---|---|---|
| 2,140,100 | 12/1938 | Boldt et al. | 192/69.8 X |
| 2,405,698 | 8/1946 | Jameson | 192/69.8 |
| 2,639,795 | 5/1953 | Munschauer | 192/69.8 |
| 2,806,567 | 9/1957 | Bonquet | 192/86 X |
| 4,741,226 | 5/1988 | Bernard et al. | 192/69.8 X |

FOREIGN PATENT DOCUMENTS

2450748A1 4/1976 Germany .

3434113C1 6/1986 Germany .

*Primary Examiner*—Rodney H. Bonck

*Attorney, Agent, or Firm*—Evenson McKeown Edwards & Lenahan, PLLC

[57] ABSTRACT

A warp beam coupling for weaving looms is used for the detachable connection and for the transmission of a rotating movement between a warp beam drive and a warp beam tube. The warp beam coupling includes a bearing bell which is driven in a rotating manner by a warp beam drive and is disposed in a warp beam bearing which has a coupling flange which can be connected with a coupling flange provided on the warp beam tube of a warp beam. In order to achieve a playfree and highly loadable connection between the warp beam drive and the warp beam, the coupling flanges are each provided with a serration, and the bearing bell has devices for its axial displacement so that the serrations can be engaged and disengaged. The bearing bell and thus the coupling flange are braced by way of tensioning devices.

22 Claims, 5 Drawing Sheets

WARP BEAM COUPLING

BACKGROUND AND SUMMARY OF THE INVENTION

This application claims the priority of German application 197 24 150.6, filed in Germany Jun. 7, 1997, the disclosure of which is expressly incorporated by reference herein.

The invention relates to a warp beam coupling for connecting a warp beam having a warp beam tube with a weaving loom. Preferred embodiments of the invention provide a bearing bell which is rotatably driven by a warp beam drive and is disposed in a warp beam bearing and has a coupling flange which can be connected with a coupling flange on the warp beam tube.

It is an object of the warp beam coupling to detachably connect the warp beam drive with the warp beam or the warp beam tube and ensure the force transmission from the drive to the warp beam tube.

In a known manner, the warp beam coupling consists, for example, of a shaft which is flanged to one end of the warp beam tube and which carries a warp beam gear wheel which, in turn, meshes with a driving pinion of a driving motor. This type of coupling has the advantage that a highly loadable and playfree force transmission from the drive to the warp beam tube is achieved. It is a disadvantage that, when the warp beam is exchanged, the flange connection between the warp beam tube and the drive shaft, which is usually secured by screws, must be disconnected which requires relatively large expenditures of time and does not exclude a faulty tightening of the screws during the recoupling.

For this reason, the so-called "EURO"-coupling was developed which has a coupling shaft which has a polygonal cross-section and can be caused to engage with an assigned receiving device on the face of the warp beam tube.

In this case, it is an advantage that, for opening up the connection, usually only one securing screw must be unscrewed and the coupling shaft can then easily be pulled out of the receiving device of the warp beam tube. Disadvantages are the limited loadability of the polygonal shaft as well as a relatively large play between the shaft and the shaft receiving device which, on the one hand, results in irregularities of the wovens and, on the other hand, leads to a premature wearing-out of the coupling parts.

It is an object of the invention to further develop a warp beam coupling for the driving connection between the warp beam tube and the warp beam drive such that, on the one hand, a force transmission is achieved which is as highly loadable as possible and has no play and, on the other hand, a fast opening up and reestablishing of the driving connection between the warp beam drive and the warp beam is permitted.

According to the invention, this object is achieved by providing a warp beam coupling of the above-mentioned general type, wherein the coupling flanges are each provided with a serration, wherein an adjusting device is provided on the bearing bell to selectively engage and disengage the serration of the coupling flange of the bearing bell and the serration of the coupling flange of the warp beam tube, and wherein the bearing bell also accommodates tensioning devices for bracing the coupling flanges which are engaging with one another.

It is an important feature of the invention that the force transmission takes place from the warp beam drive to the warp beam tube of the warp beam by means of one coupling flange respectively which coupling flanges are provided with a serration (Hirth serration) which ensures a form-locking connection with the coupling of the coupling flanges.

The coupling flanges are braced with respect to one another by means of suitable devices.

In a first preferred embodiment of the invention, it is provided that the throwing into and out of gear takes place manually, in which case the two coupling flanges are braced with one another against a disengagement by means of a single tensioning screw.

In other preferred embodiments of the invention, it is provided that the engagement and disengagement of the coupling flanges takes place automatically, for example, by means of pneumatic or hydraulic devices, in which case the coupling flanges are guided together by means of hydraulically or pneumatically operated devices and are mechanically braced with one another.

The invention has the following advantages:

The coupling and bracing takes place according to a largely defined sequence manually or automatically so that operating faults which result in an improper coupling can for the most part be avoided.

By means of the serrated coupling flanges, a playfree connection is established between the warp beam and the warp beam drive, in which case the Hirth serration results in an automatic centering, that is, an axial alignment of the warp beam with respect to the warp beam drive. The serration permits a very high torque to be transmitted which in the state of the art is achieved only by means of the known screwed flange connection.

After the coupling and bracing, no axial forces act upon the warp beam. The static bearings of the warp beam are protected.

Other objects, advantages and novel features of the present invention will become apparent from the following detailed description of the invention when considered in conjunction with the accompanying drawings.

DETAILED DESCRIPTION OF THE DRAWINGS

Figure 1:
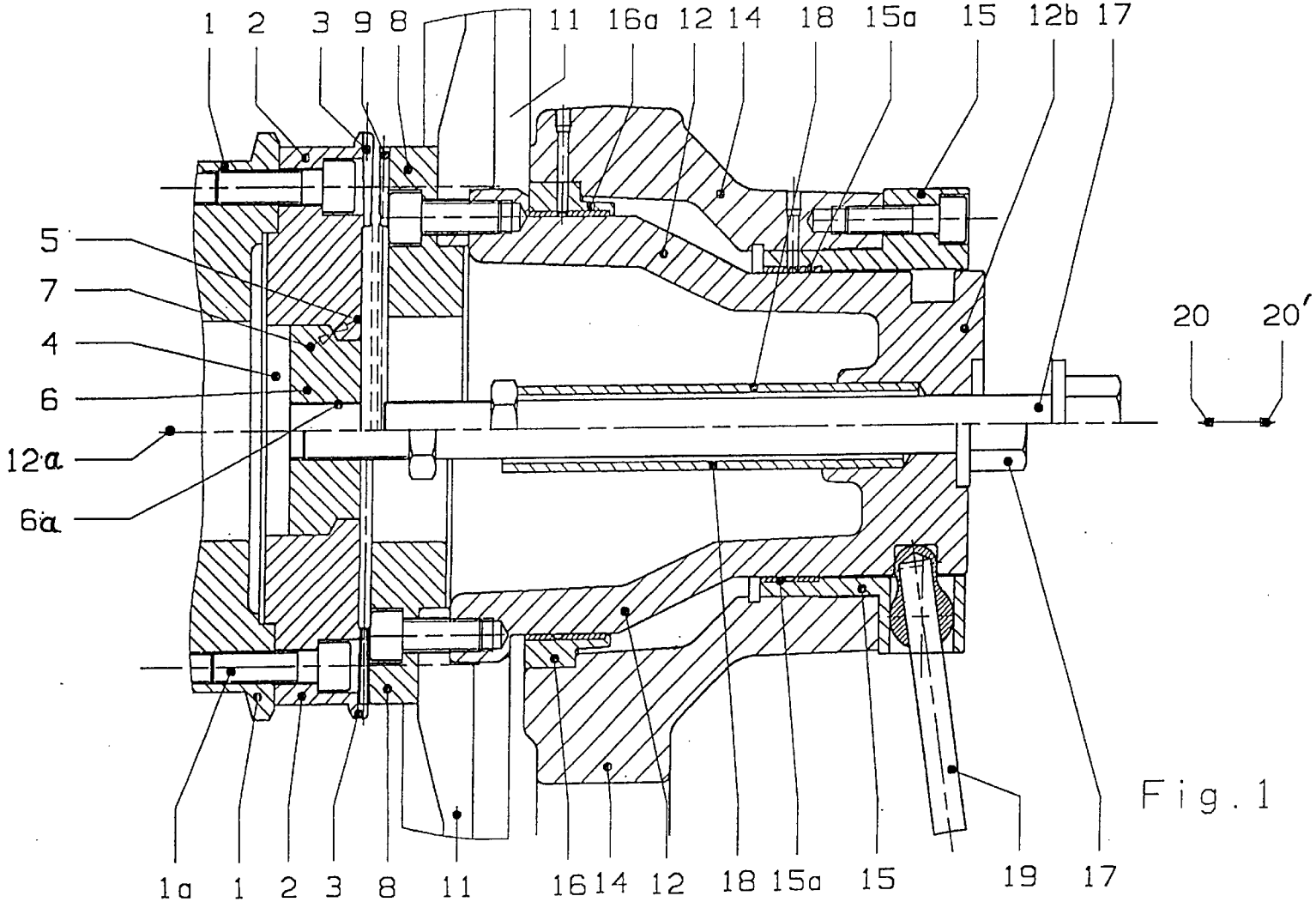
FIG. 1 is a sectional view of a first embodiment of a warp beam coupling constructed in accordance with the present invention, shown in an uncoupled position in the upper half of the drawing and in a coupled condition in the lower half of the drawing.

A first embodiment according to FIG. 1 illustrates a manually operated warp beam coupling.

A warp beam tube 1 is shown on which a coupling flange 2 is fastened on the face-side, for example, by means of screw bolts 1*a*. The coupling flange 2 is provided with a surrounding serration 3 (also called "Hirth serration"), in which the teeth extend radially with respect to the axis of rotation 12*a*.

Figure 2:
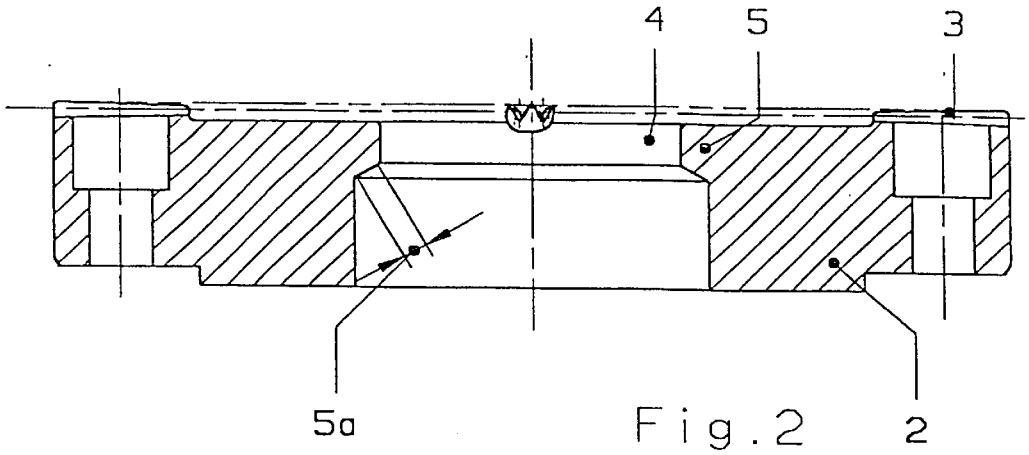
FIG. 2 is a sectional view of the warp-beam-side coupling flange according to Line A—A in FIG. 3.

The coupling flange 2 has a center bore 4 which forms a surrounding step 5 with a slope 5*a* (see also FIG. 2). A spanner 6 is inserted into the center bore 4 and rests by means of a surrounding flank 7 on the slope 5*a* of the step 5 and is held in a centered position in the coupling flange 2.

The warp beam coupling itself comprised a bearing bell 12 which can be moved in the axial direction 20 or 20' and is disposed in a warp beam bearing 14. The bearing support takes place by means of bearing rings 15, 16 fastened on the warp beam bearing 14 and assigned bearing shells 15*a*, 16*a*. By operating a lever 19, the bearing bell 12 can be displaced in the axial direction 20 or 20' with respect to the stationary warp beam bearing 14. The lever 19 is held in an opening of the warp beam bearing 14 or of a bearing ring 15 and is supported there. During the operation of the weaving loom, the lever 19 can be completely removed from its seat.

A driving gear wheel 11 is fastened to the bearing bell 12 and meshes with a corresponding driving pinion (not shown) of a driving motor (not shown).

Another coupling flange 8 is fastened on the face of the bearing bell 12 facing the warp beam tube 1 and is also provided with a surrounding serration 9 which corresponds to the serration 3 of the warp-beam-side coupling flange 2.

Around and along the axis of rotation 12*a* of the bearing bell 12, a guiding tube 18 is arranged which receives a tensioning screw 17 which, starting from the bottom 12*b* of the bearing bell 12, can be screwed into a threaded bore 6*a* arranged in the center in the connection piece 6.

Method of Operation

Above the axis of rotation 12*a* according to FIG. 1, the warp beam coupling is illustrated in an uncoupled condition; that is, the corresponding serrations 3 and 9 of the coupling flanges 2 and 8 are not engaged with one another. With respect to the stationary warp beam bearing 14, the bearing bell 12 is in its rearmost position (in the direction 20'). The warp beam or the warp beam tube 1 rests on a so-called backrest of the weaving loom (not shown) and is prepositioned and supported by it.

In order to now couple the warp beam tube 1 with the drive, the lever 19 is first operated in the direction of the arrow 20' so that the bearing bell 12 together with the driving gear wheel 11 and the coupling flange 8 moves in the axial direction 20 toward the warp-beam-side coupling flange 2, as illustrated in the lower half of FIG. 1. The coupling must naturally take place when the loom is stopped.

The displacement movement is now continued by a further operating of the lever until the serration 9 of the coupling flange 8 is in a form-locking engagement with the serration 3 of the warp-beam-side coupling flange 2. In this case, the meshing of the serrations 3, 9 may be promoted by a slight rotation of the bearing bell 12 and of the coupling flange 8 connected with the bearing bell 12.

When the serrations 3, 9 of the coupling flanges 2, 8 are engaging with one another, the tensioning screw 17 is fitted through the bottom 12*b* of the bearing bell 12 and through the guiding tube 18 and is tightened in the assigned threaded bore 6*a* of the spanner 6 with a defined tightening torque. As a result, a form closure as well as a force closure is achieved between the two coupling flanges 2 and 8. A playfree connection is established between the coupling flange 2 of said warp beam tube 1 of the warp beam and the coupling flange 8 of said warp beam drive (driving gear wheel 11).

It is important that, after the connecting of the coupling flanges 2 and 8, no axial forces act upon the warp beam, and the warp beam is now disposed on the coupling side only in the warp beam bearing 14; that is, it rests no longer on the backrest. In addition, by means of the Hirth serration, an automatic centering of the warp beam tube 1 advantageously takes place with respect to the warp beam bearing 14.

Figure 3:
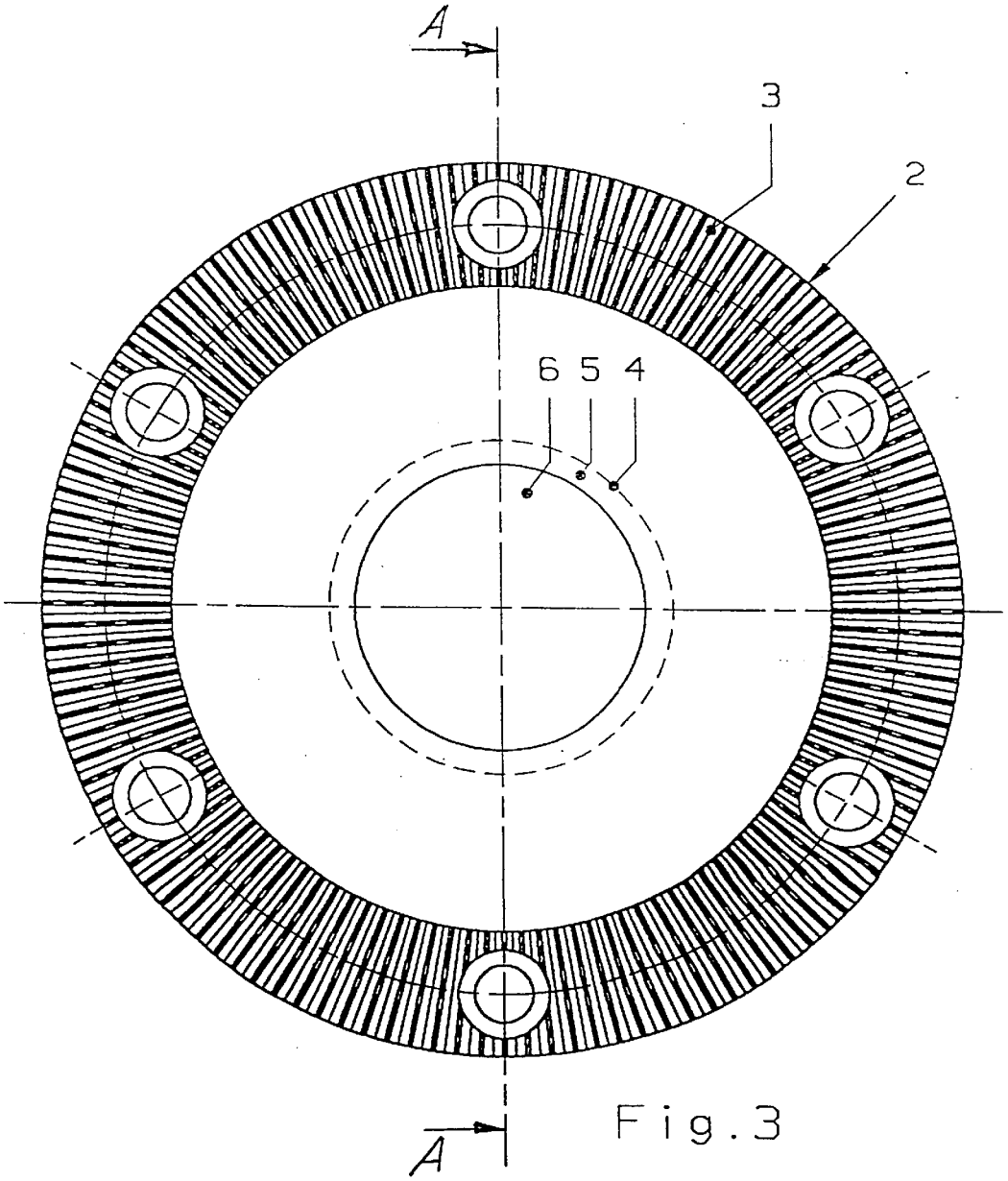
FIG. 3 is a top view of the warp-beam-side coupling flange.

FIGS. 2 and 3 illustrate the warp-beam-side coupling flange 2. The stepped center bore 4 into which the spanner 6 is inserted according to FIG. 1, as well as the surrounding radial serration 3 are shown. The serration 3 may be constructed to be radial in a straight line as well as radially sloped.

Figure 4:
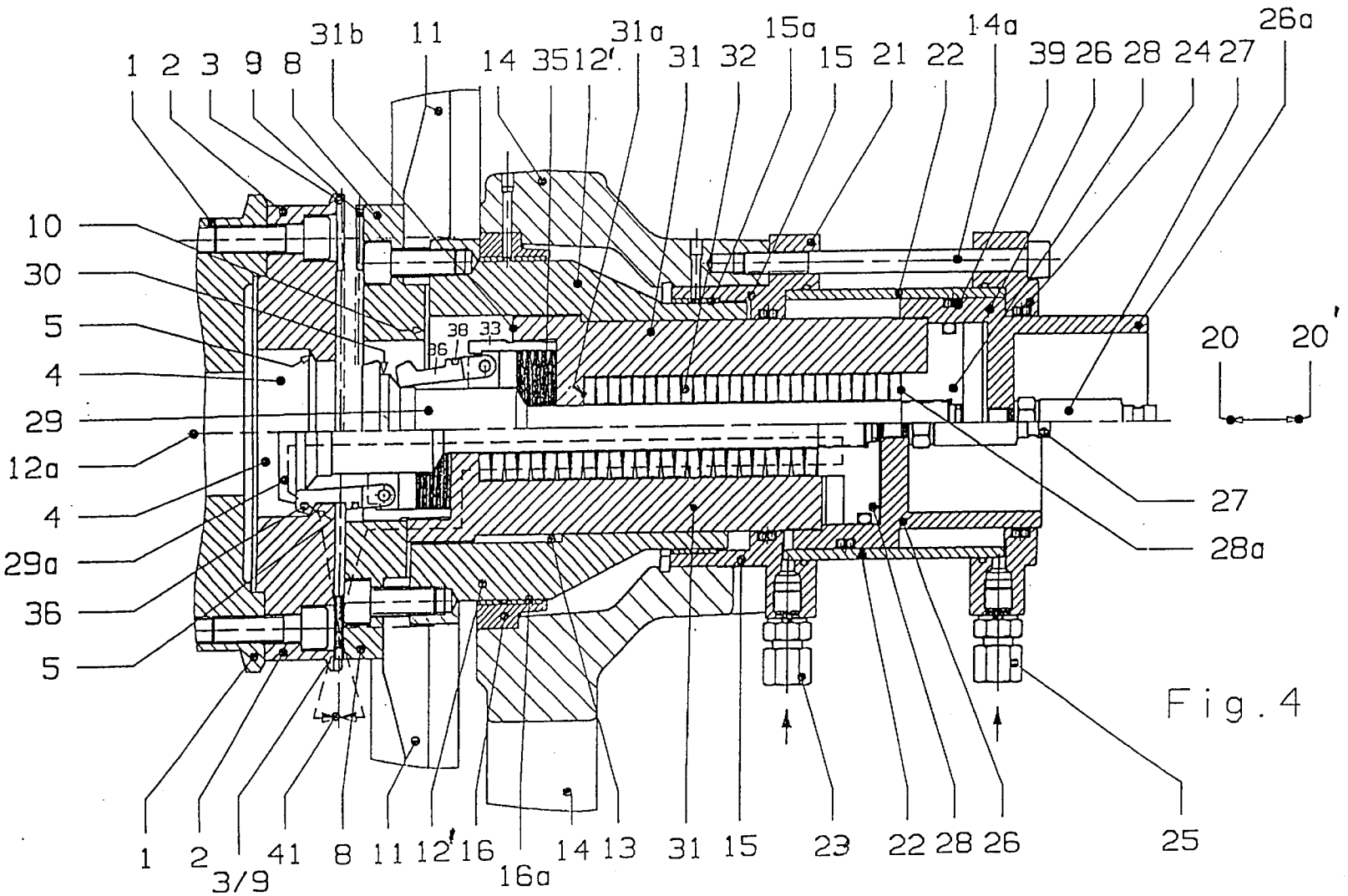
FIG. 4 is a sectional view of a second embodiment of a warp beam coupling constructed in accordance with the present invention, shown in an uncoupled position in the upper half of the drawing and in a coupled condition in the lower half of the drawing.
Figure 5:
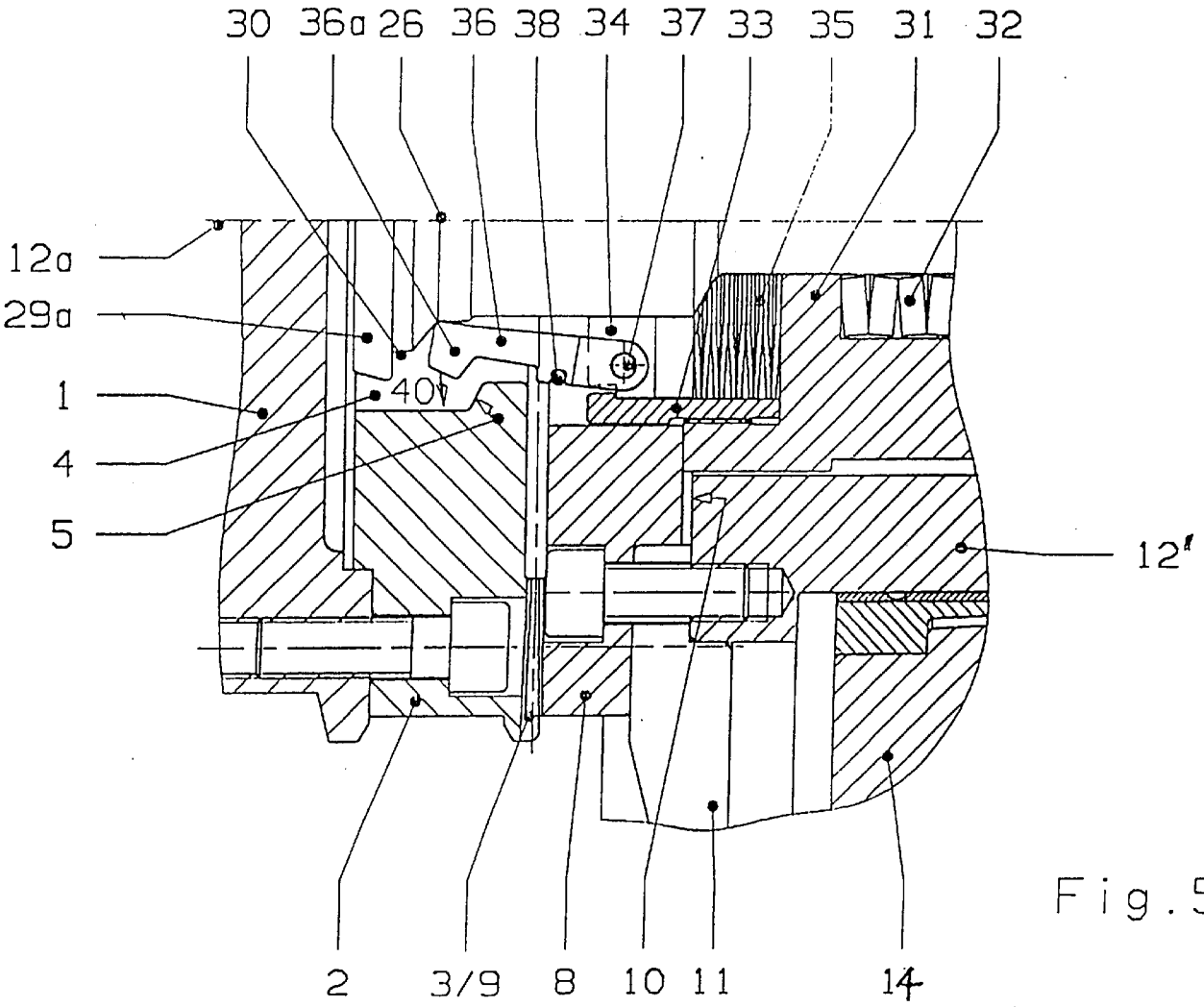
FIG. 5 is a partial sectional view of the warp beam coupling of FIG. 4 in the area of the coupling flanges, shown before the claw connection is operated.

FIGS. 4 and 5 illustrate a second embodiment of the coupling device, in the case of which the coupling can take place automatically.

With respect to FIG. 1, similar parts have the same reference numbers in FIGS. 4 and 5.

An important difference with respect to the first embodiment is the fact that no spanner 6 is required for bracing the coupling flanges 2, 8.

The bearing bell 12' is constructed as a rotationally symmetrical part which is open on both sides and is, in turn, disposed in the warp beam bearing 14.

The bearing ring 15 comprises a basic flange 21 in which one end of a pneumatic cylinder 22 is received. The other end of the pneumatic cylinder 22 is closed off by means of a cylinder cover 24. The cylinder cover 24, the cylinder 22 and the basic flange 21 are fixedly connected with the warp beam bearing 14 by means of screws 14*a*.

In the pneumatic cylinder 22, a hollow piston 26 is movably received which is supported on the interior wall of the pneumatic cylinder 22 and is supported by means of a tube-shaped projection 26*a* on the interior circumference of the cylinder cover 24. One compressed-air connection 23 and 25 respectively is provided on the basic flange 21 and on the cylinder cover 24 so that the hollow piston 26 can operate in both directions 20 and 20'.

In the bottom of the hollow piston 26, a rapid-action coupling 27 is situated which can be acted upon by the pressure medium and is connected with the piston 26.

Inside the hollow piston 26, which is constructed, for example, as a working cylinder which can be acted upon pneumatically or hydraulically, a piston 28 which can be acted upon by the pressure medium is displaceably arranged and carries a piston rod 29 which extends in the axial direction 20. The piston rod 29 extends inside a connection sleeve 31 which, in turn, is fastened on the hollow piston 26 and is slidably arranged in the axial direction 20, 20' within the bearing bell 12'. Inside the connection sleeve 31, a spring assembly 32 is arranged which surrounds the piston rod 29 and which is supported on the one side on a face-side ring surface 31*a* of the connection sleeve 31 and, on the other side, on the bottom 28*a* of the piston 28.

On the face of the connection sleeve 31, a holding sleeve 33 for a claw carrier 34 is arranged in an assigned opening, which claw carrier 34 is shown best in FIG. 5 and which is prestressed by a spring 35 arranged in the holding sleeve, for example, by one or several cup springs. The claw carrier 34 comprises several radially arranged claws 36 which extend in the axial direction 20 and which are arranged to be swivellable about an axis 37 on the claw carrier 34.

By means of an annular spring 38, the claws 36 are prestressed in their functionless position. The claws 36 are movable to the outside in the radial direction and are operated by sliding along the guiding edge 30 situated on the free end of the piston rod 29.

The free ends of the claws 36 each have a type of detent nose 36*a* which is provided for being placed on the slope 5*a* of the surrounding step 5 situated in the center bore 4 of the warp-beam-side coupling flange 2, the seat of the claws 36 being secured by the piston rod 29.

Method of Operation

Above the axis of rotation 12*a* according to FIG. 4, the warp beam coupling is illustrated in an uncoupled condition. In this case, the hollow piston 26 is in its rearmost position (direction of the arrow 20'). Pressure is applied to the compressed-air connection 23; while the compressed-air connection 25 is without pressure.

Below the axis of rotation 12*a*, the piston 28 is in its frontmost position (direction of the arrow 20). Pressure is applied to the connection 25, in which case the piston rod 29 connected with the piston 28 is pressed toward the front (in the direction of the arrow 20) against the force of the spring assembly 32 so that the claws 36 are first held in their functionless position by the force of the spring 35.

Thus, if the compressed-air connection 23 becomes pressureless and the compressed-air connection 25 is acted upon simultaneously, an axial displacement of the hollow piston 26 is caused relative to the warp beam bearing 14. As a result, the components situated on or in the hollow piston 26, specifically the connection sleeve 31, the piston 28 with the piston rod 29, the spring assembly 32, the claw carrier 34 with the claws 36, are displaced in the direction of the arrow 20. When the hollow piston 26 is acted upon, the connection sleeve 31 is displaced until it strikes by means of its face-side ring surface 31*b* against an interior stop 10 of the coupling flange 8 and in the process presses the coupling flange 8 in the direction of the arrow 20 of the warp-beam-side coupling flange 2 so that the serrations 3 and 9 of the coupling flanges 2 and 8 are brought into a mutual form-locking engagement.

FIG. 5 shows the position of the claws 36 before these are form-lockingly engaged with the coupling flange 2.

The coupling flanges 2 and 8 adjoin one another, the claws 36 still being in their radially innermost position (functionless position).

When the pressure medium supply is deactivated; that is, the piston 28 is relieved from pressure, the piston 28 and the piston rod 29 are pressed in the direction of the arrow 20' by the force of the spring assembly 32. During the backward movement of the piston rod 29, the claws 36 slide along its guiding edge 30. As a result, the claws 36 are pressed in the direction of the arrow 40 and establish a form closure at the step 5 of the warp-beam-side coupling flange 2. In this case, the form-locking position of the claws 36 is secured by the geometrically constructed free end 29*a* of the piston rod 29 acting upon the claws 36.

Thus, the two coupling flanges 2, 8 are secured against being detached from one another. In the lower half of FIG. 4, thus below the axis of rotation 12*a*, the tensioning force onto the piston rod 29 for locking the claws 36 is applied only by means of the spring assembly 32.

The flux of force in the individual components is illustrated by the broken line 41. It is important that no significant force acts upon the bearing of the claws 36 but only the free extreme end of the claws is used for transmitting force. Possible low axial forces onto the claws 36 are absorbed by the resilient bearing of the claw carrier 34.

The opening-up of the locking and the uncoupling of the warp beam from the weaving loom takes place in a sequence which is in reverse of the above-described sequence.

Then the claws are detached from their seat in that the piston 28 is acted upon which moves the piston rod 29 in the direction of the arrow 20 so that the claws 36 slide along the guiding edge and are swivelled against the direction of the arrow 40 by the force of the annular spring 38.

After the claws 36 have been detached, the pneumatic system is operated; that is, compressed air is applied to the compressed air connection 23 so that connection sleeve 31 moves in the direction of the arrow 20' and in the process strikes against an interior stop 13 of the bearing bell 12' (see also FIG. 4). As a result, the bearing bell 12' is taken along in the direction of the arrow 20' so that the coupling flange 8 detaches from the warp-beam-side coupling flange 2.

It should also be mentioned that the piston 26 is sealed off with respect to the cylinder 22 by radially as well as axially acting sealing assemblies 39.

Figure 6:
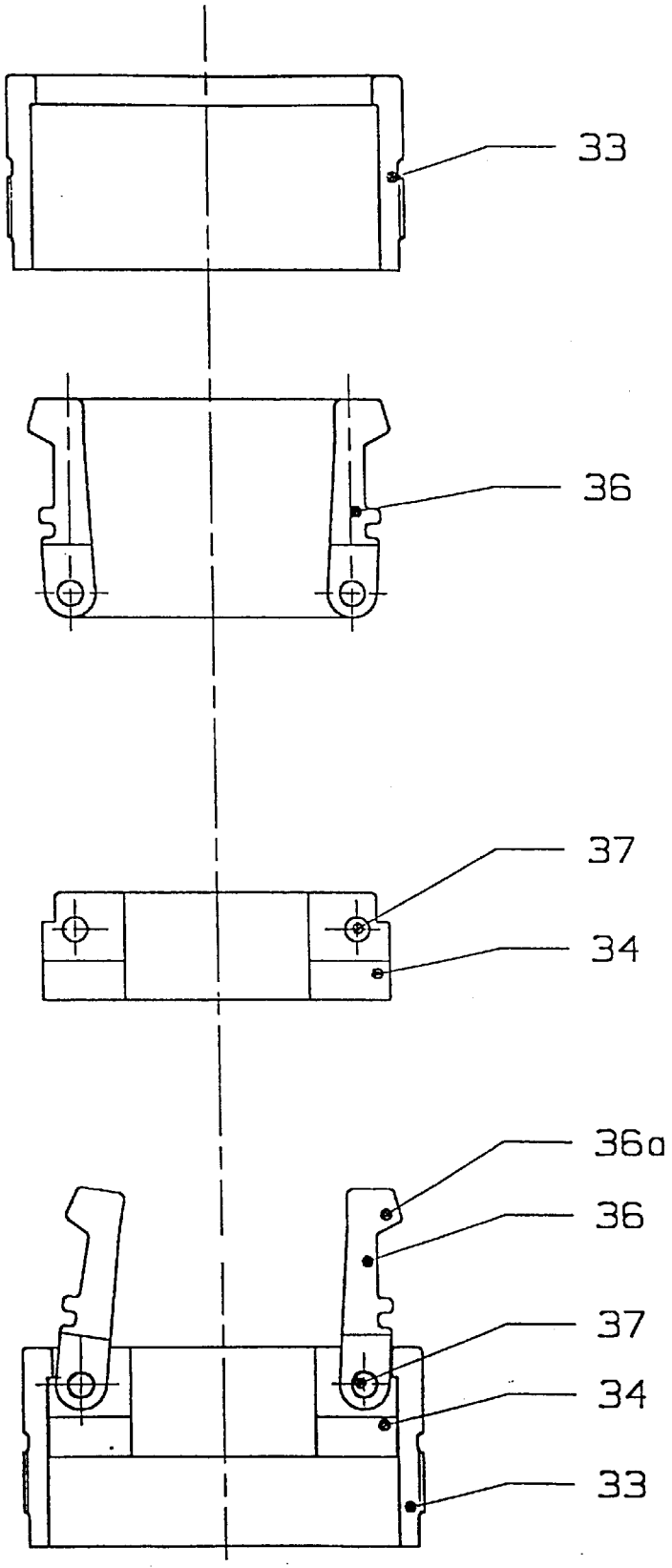
FIG. 6 is a representation of the component parts of the claw carrier of the embodiments of FIGS. 4 and 5, with the claws accommodated in the holding sleeve.

FIG. 6 is a representation of the components of the holding sleeve 33 with the claw carrier 34 having the claws 36 arranged therein. The whole arrangement is held in the connection sleeve 31 in a receiving device enclosed by the ring surface 31*b*. The holding sleeve 33 is preferably connected with the connection sleeve 31 by way of a thread.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. Warp beam coupling for weaving looms, having a bearing bell which is rotatingly driven by a warp beam drive and is disposed in a warp beam bearing and which has a coupling flange which can be connected with a coupling flange situated on a warp beam tube of a warp beam, wherein the coupling flanges are each provided with a serration, wherein an adjusting device is provided on the bearing bell to selectively engage and disengage the serration of the coupling flange of the bearing bell and the serration of the coupling flange of the warp beam tube, and wherein the bearing bell also accommodates tensioning devices for bracing the coupling flanges which are engaging with one another.

2. Warp beam coupling according to claim 1, wherein the serrations are arranged on a surrounding circular surface of the coupling flanges and point radially to the outside.

3. Warp beam coupling according to claim 1, wherein the warp beam side coupling flange has a stepped center bore with a step facing axially away from the axial direction of the serrations on the warp beam side coupling flange.

4. Warp beam coupling according to claim 3, wherein that the tensioning devices for bracing the coupling flanges comprise a tensioning screw accommodated in a guiding tube inside the bearing bell and a spanner supported in the warp-beam-side coupling flange.

5. Warp beam coupling according to claim 4, wherein the adjusting device is operable to displace the bearing bell and includes a manually operable lever which is fixedly supported on the warp beam bearing and acts upon the bearing bell.

6. Warp beam coupling according to claim 3, wherein the adjusting device is operable to displace the coupling flange and includes a piston-cylinder unit which can be acted upon by a pressure medium.

7. Warp beam coupling according to claim 6, wherein the tensioning device includes a spring assembly interacting with the piston-cylinder unit and a holding sleeve holding several, radially swivellably disposed claws, and wherein the claws, together with a surrounding step situated on the coupling flange form a locking assembly.

8. Warp beam coupling according to claim 7, wherein a piston operates a piston rod which is prestressed by means of the spring assembly.

9. Warp beam coupling according to claim 8, wherein on a forward free end, the piston rod forms a guiding edge which, when the piston rod is displaced in the axial direction, causes the radial swivel motion of the claws from the functionless position to the outside.

10. Warp beam coupling according to claim 1, wherein the adjusting device is operable to displace the bearing bell and includes a manually operable lever which is fixedly supported on the warp beam bearing and acts upon the bearing bell.

11. Warp beam coupling according to claim 1, wherein that the tensioning devices for bracing the coupling flanges comprise a tensioning screw accommodated in a guiding tube inside the bearing bell and a spanner supported in the warp-beam-side coupling flange.

12. Warp beam coupling according to claim 1, wherein the adjusting device is operable to displace the coupling flange and includes a piston-cylinder unit which can be acted upon by a pressure medium.

13. Warp beam coupling according to claim 12, wherein the tensioning devices include a spring assembly interacting with the piston-cylinder unit, and a holding sleeve holding several, radially swivellably disposed claws, and wherein the claws, together with a surrounding step situated on the coupling flange form a locking assembly.

14. Warp beam coupling according to claim 13, wherein the claws are mounted on a claw carrier so that they can be swivelled about an axis, which claw carrier is accommodated in the holding sleeve while a spring is tensioned.

15. Warp beam coupling according to claim 14, wherein the claws are prestressed in their functionless position by means of an annular spring.

16. Warp beam coupling according to claim 13, wherein the piston-cylinder unit is integrated in a hollow piston and is displaceable in an axial direction together with the hollow piston.

17. Warp beam coupling assembly for weaving looms, comprising:

a warp beam bearing, a bearing bell rotatably disposed in the warp beam bearing and being drivingly connectable with a warp beam drive, a coupling flange on a warp beam tube of a warp beam, a coupling flange on the bearing bell, serrations provided on said coupling flanges to form a driving connection when said coupling flanges are moved axially from a non-driving position to a driving position, an adjusting device operable to move the coupling flanges between the non-driving and driving positions, and a tensioning device operable to brace the coupling flanges in said driving position.

18. Warp beam coupling according to claim 17, wherein the adjusting device is operable to displace the bearing bell and includes a manually operable lever which is fixedly supported on the warp beam bearing and acts upon the bearing bell.

19. Warp beam coupling according to claim 18, wherein the tensioning device includes a tensioning screw and a spanner disposed along an axis through the bearing bell and warp beam tube.

20. Warp beam coupling according to claim 17, wherein the tensioning device includes a tensioning screw and a spanner disposed along an axis through the bearing bell and warp beam tube.

21. Warp beam coupling according to claim 17, wherein the adjusting device includes a fluid operated piston and cylinder unit.

22. Warp beam coupling according to claim 17, wherein the tensioning device includes radially movable claws on a holding sleeve connected with a fluid operated piston and cylinder unit.

* * * * *